US010920563B2

(12) United States Patent
Mower

(10) Patent No.: US 10,920,563 B2
(45) Date of Patent: Feb. 16, 2021

(54) HORIZONTAL DRILLING DEVICE AND METHOD OF USING THE SAME

(71) Applicant: Timothy B. Mower, Illion, NY (US)

(72) Inventor: Timothy B. Mower, Illion, NY (US)

( * ) Notice: Subject to any disclaimer, the term of this patent is extended or adjusted under 35 U.S.C. 154(b) by 70 days.

(21) Appl. No.: 16/383,851

(22) Filed: Apr. 15, 2019

(65) Prior Publication Data

US 2019/0338629 A1 Nov. 7, 2019

Related U.S. Application Data

(60) Provisional application No. 62/658,877, filed on Apr. 17, 2018.

(51) Int. Cl.

| | |
|---|---|
| ***E21B 7/04*** | (2006.01) |
| ***E21B 44/00*** | (2006.01) |
| ***E21B 47/024*** | (2006.01) |
| ***E21B 47/13*** | (2012.01) |

(52) U.S. Cl.

CPC ..... *E21B 44/005* (2013.01); *E21B 7/046* (2013.01); *E21B 47/024* (2013.01); *E21B 47/13* (2020.05)

(58) Field of Classification Search

CPC . E21B 7/04; E21B 7/046; E21B 15/04; E21B 44/02; E21B 44/00; E21B 47/024

See application file for complete search history.

(56) References Cited

U.S. PATENT DOCUMENTS

| | | | | |
|---|---|---|---|---|
| 4,399,877 | A * | 8/1983 | Jackson | E21B 7/046 166/65.1 |
| 4,904,996 | A | 2/1990 | Farnandes | |
| 4,993,503 | A * | 2/1991 | Fischer | E21B 7/064 175/62 |
| 5,469,155 | A | 11/1995 | Archambeault et al. | |
| 5,720,354 | A | 2/1998 | Stump | |
| 6,470,976 | B2 | 10/2002 | Alft et al. | |
| 7,219,749 | B2 * | 5/2007 | Kuckes | E21B 7/046 175/45 |
| 7,225,885 | B2 | 6/2007 | Mercer | |
| 8,418,782 | B2 * | 4/2013 | Waters | E21B 47/0228 175/45 |
| 2011/0137618 | A1 * | 6/2011 | Fluharty, II | G06Q 30/0283 703/1 |
| 2016/0298443 | A1 * | 10/2016 | Ariaratnam | E21B 7/04 |
| 2016/0348496 | A1 * | 12/2016 | Brune | E21B 47/024 |

* cited by examiner

*Primary Examiner* — Kenneth L Thompson
(74) *Attorney, Agent, or Firm* — GFD Patents LLC; Gerald F. Dudding

(57) ABSTRACT

An apparatus and method for horizontal drilling under a body of water or other obstacle impassable by foot is disclosed. The apparatus includes a locator box, a horizontal drill rig with a drill head, a transmitter operably coupled to the drill head, a suspension assembly extending over the obstacle above a bore hole line, and a remote control device paired with the locator box capable of wirelessly sending instructions and wirelessly receiving data from the locator box. The locator box is operably coupled to the suspension assembly that allows it to be positioned at any point along the suspension assembly. In the present method, the locator box follows along the drilling path, roughly at the level of the drill head, in order to accurately read information about the position, pitch, and temperature of the drill head, without requiring an operator to follow the path.

37 Claims, 4 Drawing Sheets

HORIZONTAL DRILLING DEVICE AND METHOD OF USING THE SAME

I. FIELD OF THE INVENTION

The present invention relates generally to devices used for wireless control of a horizontal drilling device, and a method of using the same.

II. BACKGROUND

In horizontal drilling, a locator box is used to follow along the drilling path, roughly at the level of the drill head, in order to accurately read information about the position, pitch, and temperature of the drill head. This is done at regular intervals, consisting of aligning the locator box with the drill head, holding the locator box still, pulling the locator box's trigger to obtain a reading, and then reading the result. When drilling in an area such as underneath a body of water, over a road, or other such obstacle, this still has to be done by a person following above the drill head, often using makeshift devices such as a boat or sledge. This is incredibly inefficient, taking several times longer to get accurate readings, and placing the operator at considerable risk in colder temperatures. Thus, there is a need for a method of allowing the locator box to follow the path of the drill head without requiring an operator following the path themselves. Therefore, there is a present need for a method of moving a locator box along the path of a drill head remotely, a method of modifying existing control boxes to be operated remotely, and a method of use for remotely controlling a locator box.

III. SUMMARY OF THE INVENTION

A first aspect of the present invention provides a method for horizontal drilling under a body of water or other obstacle impassable by foot. The method provides a locator box, a horizontal drill rig with a drill head, a transmitter operable coupled to the drill head, a suspension assembly extending over the obstacle above a bore hole line, and a remote control device paired with the locator box capable of wirelessly sending instructions and wirelessly receiving data from the locator box. A first step of the method comprises attaching the locator box to the suspension assembly. The suspension assembly allows the locator box to be positioned at any point along the suspension assembly. A second step of the method comprises using the horizontal drill rig to drill along the bore hole line. A third step of the method comprises remotely using the locator box to collect data on the position, pitch and temperature of the drill head. A fourth step of the method comprises redirecting the drill head if it strays off of the bore hole line using the data from the locator box. The second through fourth steps are repeated until the drill head has passed beyond the obstacle impassible by foot.

A second aspect of the present invention provides an apparatus for horizontal drilling under an obstacle impassable by foot. The apparatus has a locator box, a horizontal drill rig with a drill head, a transmitter operably coupled to the drill head, a suspension assembly extending over the obstacle above a bore hole line, and a remote control device paired with the locator box capable of wirelessly sending instructions and wirelessly receiving data from the locator box. The locator box is operably coupled to the suspension assembly. The suspension assembly allows the locator box to be positioned at any point along the suspension assembly.

BRIEF DESCRIPTION OF THE DRAWINGS

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE EMBODIMENTS OF THE INVENTION

Figure 1:
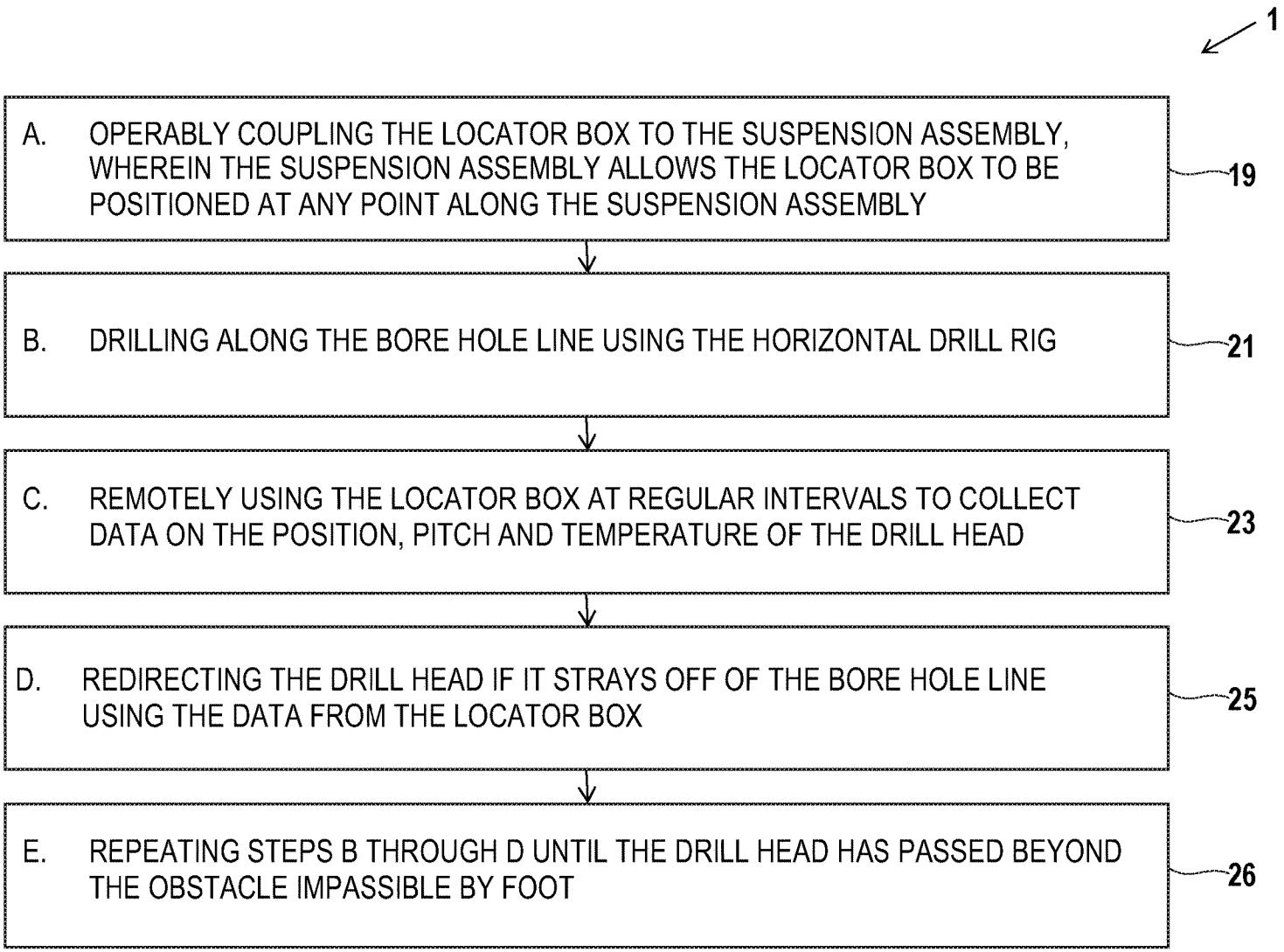
FIG. 1. depicts a flow chart of a method for horizontal drilling under a body of water or other obstacle impassable by foot, in accordance with embodiments of the present invention.
Figure 3:
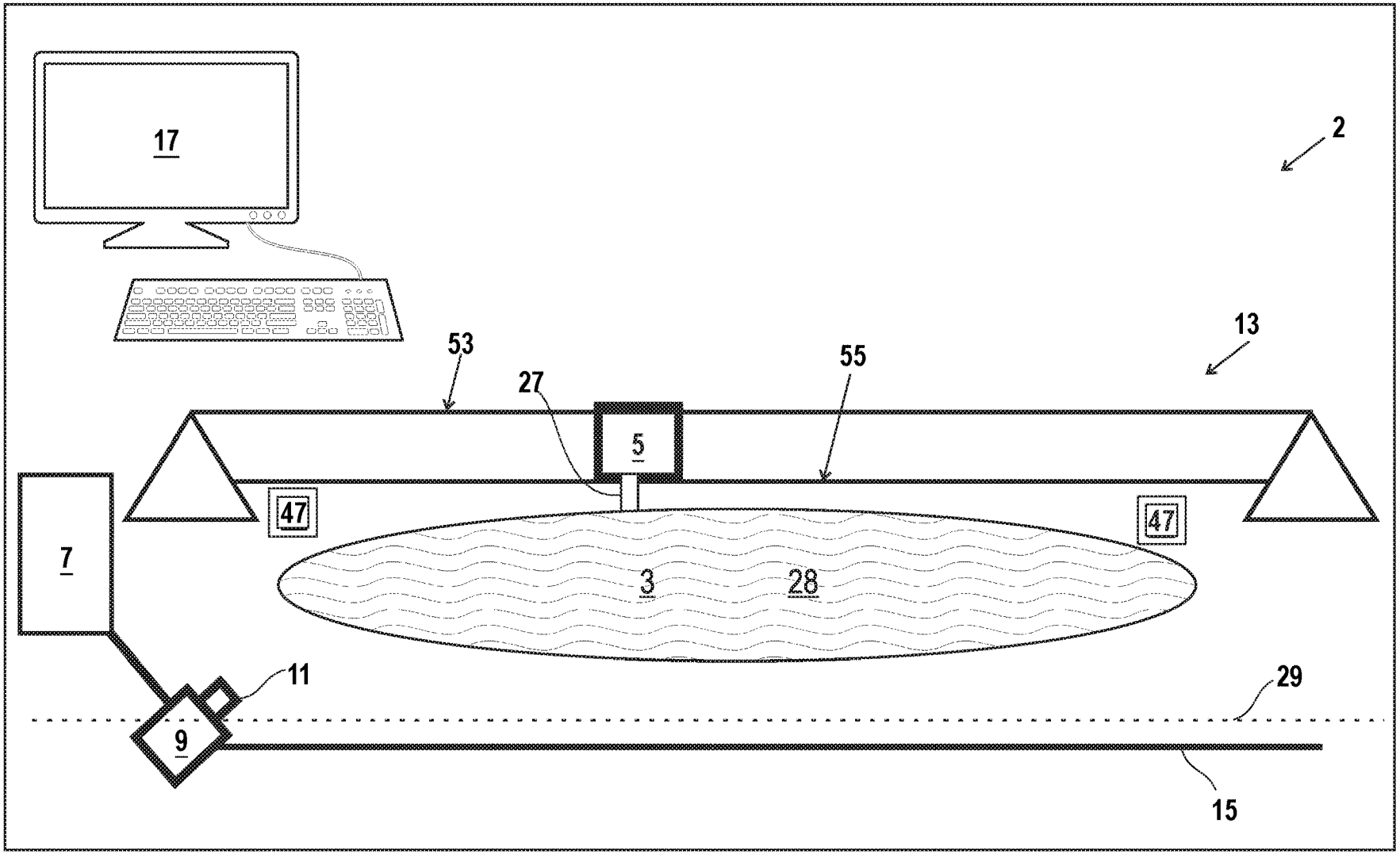
FIG. 3 depicts a schematic diagram of a locator box, horizontal drill rig with drill head, transmitter, suspension assembly and remote control device in use, in accordance with embodiments of the present invention.

FIG. 1. depicts a flow chart of a method for horizontal drilling under a body of water or other obstacle impassable by foot, in accordance with embodiments of the present invention. A first aspect of the present invention provides a method 1 for horizontal drilling under a body of water or other obstacle impassable by foot 3. The method provides a locator box 5, a horizontal drill rig 7 with a drill head 9, a transmitter 11 operable coupled to the drill head 7, a suspension assembly 13 extending over the obstacle 3 above a bore hole line 15, and a remote control device 17 paired with the locator box 5 capable of wirelessly sending instructions and wirelessly receiving data from the locator box 5, as shown in FIG. 3. A first step 19 of the method 1 comprises attaching the locator box 5 to the suspension assembly 13. The suspension assembly 13 allows the locator box 5 to be positioned at any point along the suspension assembly. A second step 21 of the method comprises using the horizontal drill rig 7 to drill along the bore hole line 15. A third step 23 of the method comprises remotely using the locator box 5 at regular intervals to collect data on the position, pitch and temperature of the drill head. A fourth step 25 of the method comprises redirecting the drill head 9 if it strays off of the bore hole line 15 using the data from the locator box 5. The second through fourth steps 21, 23, 25 are repeated until the drill head 9 has passed beyond the obstacle impassible by foot 3.

The suspension assembly can be anchored or suspended by any means necessary to ensure that the suspension assembly 13 fully extends over the obstacle impassable by foot 3.

In one embodiment, the obstacle impassable by foot 3 is a body of water 28.

In an embodiment, a bobber may be attached to the locator box 5 in order to visually confirm the distance off the water for accurate readings.

In an embodiment, a tag line may be attached in case of electrical failures or difficulties.

In one embodiment, a sonar device 27 is mounted under the locator box 5. The sonar device 27 is used in order to get detailed information on how deep the body of water 28 is. The depth of the body of water is used to calculate the safe depth for horizontal drilling 29 under the body of water.

Figure 2:
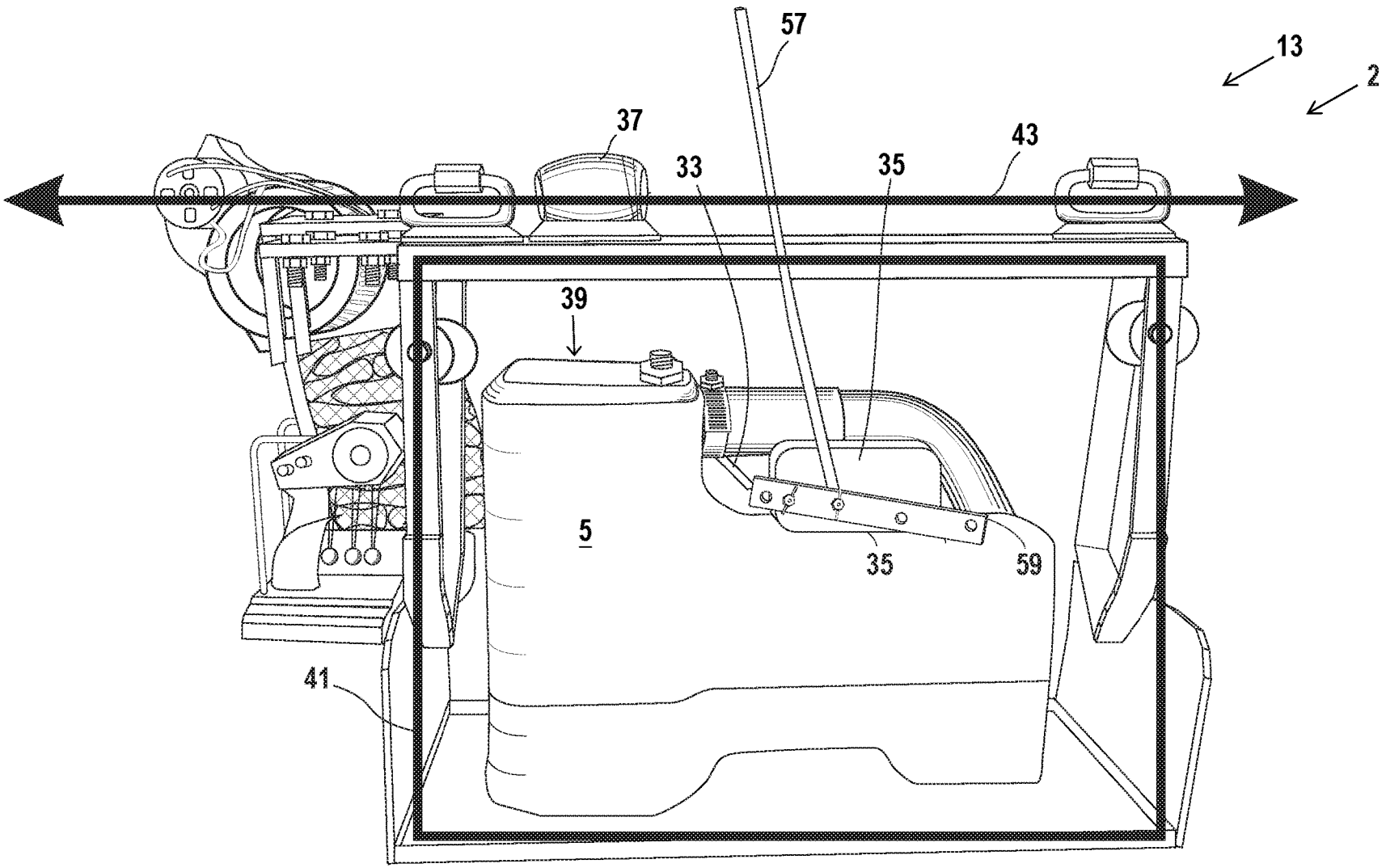
FIG. 2 depicts a side elevation view of a modified locator box and suspension assembly, in accordance with embodiments of the present invention.

FIG. 2 depicts a locator box 5, in which a trigger 33 of the locator box 5 has been coupled using a rectangular coupler 59 to servo motor 35, such that rotating the rectangular coupler 59 by action of the servo motor 35 can depress or release the trigger 33. The servo can be remotely activated by the remote control device 17, receiving instructions through a wireless receiver 57. A camera 37 has been attached to the suspension assembly 13 such that the camera's view includes the locator box's display screen 39. The camera 37 can be wirelessly activated and wirelessly send pictures or video to the remote control device 17.

In an embodiment, the remote control device is a laptop, cell phone, or tablet.

In an embodiment, the method also comprises a waterproof housing 41 holding the locator box 5 when the locator box 5 is operably coupled to the suspension assembly 13.

FIG. 3 depicts a schematic diagram of a locator box, horizontal drill rig with drill head, transmitter, suspension assembly and remote control device in use, in accordance with embodiments of the present invention. In an embodiment, the suspension assembly 13 also comprises a first parallel line 53 operably coupled above the locator box 5, and a second parallel line 55 operably coupled below the locator box 5, and suspending the locator box 5 between them. This allows the locator box 5 to be moved to any point along the suspension assembly without unwanted lateral motion, which could interfere with readings.

Figure 4:
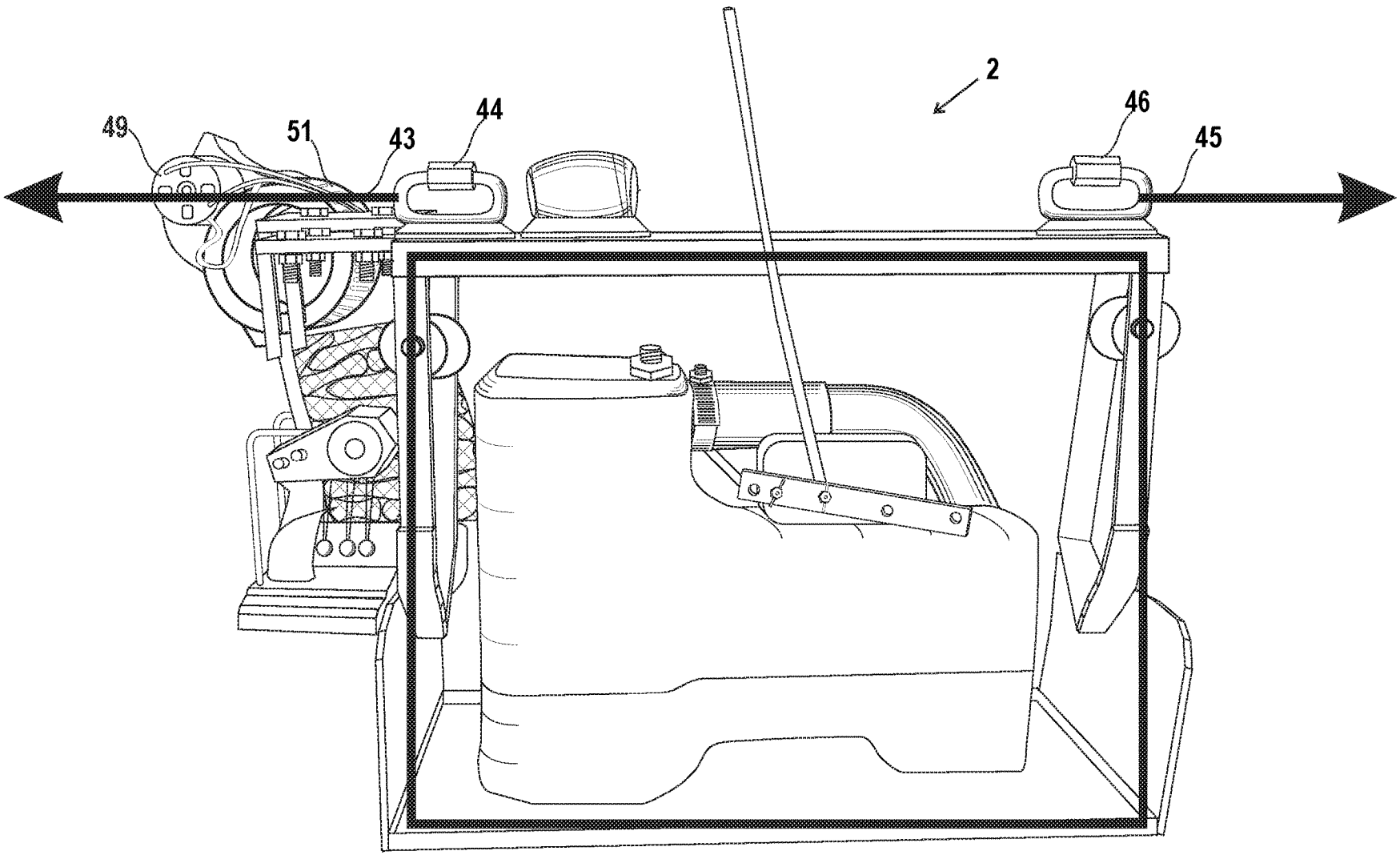
FIG. 4 depicts a side elevation view of a locator box and suspension assembly, in accordance with embodiments of the present invention.

FIG. 4 depicts a side elevation view of a locator box and suspension assembly, in accordance with embodiments of the present invention. In an embodiment, the suspension assembly 13 also comprises a first line 43 operably coupled to a first carabiner 44 which is in turn operably coupled to the locator box 5, and a second parallel line 45 operably coupled to a second carabiner 46, which is in turn operably coupled to the locator box 5. By pulling on either line, the locator box 5 can be moved to any point along the suspension assembly 13.

In an embodiment, the transmitter 11 alerts the remote control device 17 upon contact with an electrical source.

In an embodiment, the remote control device 17 is a laptop, cell phone, or tablet. The remote control device 17 may be connected to the transmitter 11 over wifi, cellular data, radio signals, or other wireless methods of communication.

In an embodiment, the remote control device 17 can transmit a signal to operate the drill head. In another embodiment, the remote control device 17 can transmit a signal to stop drilling, in the event of an emergency.

In an embodiment, the suspension assembly 13 is marked with warning signs 47 to warn away observers from the immediate area of the drill.

In an embodiment, the suspension assembly 13 contains a motor 49 to automatically position the locator box 5 at any point along the suspension assembly 13.

In an embodiment, a wheel 51 is rotatably coupled to the motor 49, wherein the wheel 49 rests on the suspension assembly 13, and wherein the remote control device 17 can transmit a signal to the motor 49, instructing the motor 49 to operate, moving the wheel 51, motor 49 and locator box 5 to any position along the suspension assembly 13.

In an embodiment, the locator box 5 is automatically moved alongside the drill head whenever the drill head changes position.

In an embodiment, the locator box 5 records the signal strength of the transmitter 11.

In an embodiment, the remote control device 17 issues an alert when the locator box 5 records a background noise level that may potentially interfere with transmission.

In an embodiment, the suspension assembly 13 is constructed from one or more materials selected from the group consisting of metals, plastics, ropes, cables, cabling, and wire.

There is an apparatus 2 for horizontal drilling under an obstacle 3 impassable by foot. The apparatus has a locator box 5, a horizontal drill rig 7 with a drill head 9, a transmitter 11 operably coupled to the drill head 9, a suspension assembly 13 extending over the obstacle 3 above a bore hole line 15, and a remote control device 17 paired with the locator box 5 capable of wirelessly sending instructions and wirelessly receiving data from the locator box 5. The locator box 5 is operably coupled to the suspension assembly 13. The suspension assembly 13 allows the locator box 5 to be positioned at any point along the suspension assembly 13.

In one embodiment, the obstacle impassable by foot 3 is an obstacle from the group consisting of a body of water 28 or a road.

In one embodiment where the obstacle impassable by foot 3 is a body of water 28, a sonar device 27 is mounted under the locator box 5. The sonar device 27 is used in order to get detailed information on how deep the body of water 28 is. The depth of the body of water is used to calculate the safe depth for horizontal drilling 29 under the body of water.

In an embodiment, a trigger 33 of the locator box 5 has been coupled to a servo motor 35 that can depress or release the trigger 33. The servo motor can be remotely activated by the remote control device 17. A camera 37 has been attached to the suspension assembly 13 such that the camera's view includes the locator box's display screen 39. The camera 37 can be wirelessly activated and wirelessly send pictures or video to the remote control device 17.

In an embodiment, the remote control device is a laptop, cell phone, or tablet.

In an embodiment, the apparatus 2 has a waterproof housing 41 holding the locator box 5 when the locator box 5 is operably coupled to the suspension assembly 13.

In an embodiment, the suspension assembly 13 also comprises a first parallel line 43 operably coupled above the locator box 5, and a second parallel line operably coupled below the locator box 5, and suspending the locator box 5 between them. This allows the locator box 5 to be moved to any point along the suspension assembly without unwanted lateral motion, which could interfere with readings.

In an embodiment, the suspension assembly 13 also comprises a first line 43 operably coupled to a first carabiner 44 which is in turn operably coupled to the locator box 5, and a second parallel line 45 operably coupled to a second carabiner 46, which is in turn operably coupled to the locator box 5. By pulling on either line, the locator box 5 can be moved to any point along the suspension assembly 13.

In an embodiment, the transmitter 11 alerts the remote control device 17 upon contact with an electrical source.

In an embodiment, the remote control device 17 is a laptop, cell phone, or tablet. The remote control device 17 may be connected to the transmitter 11 over wifi, cellular data, radio signals, or other wireless methods of communication.

In an embodiment, the remote control device 17 can transmit a signal to operate the drill head. In another embodiment, the remote control device 17 can transmit a signal to stop drilling, in the event of an emergency.

In an embodiment, the suspension assembly 13 is marked with warning signs 47 to warn away observers from the immediate area of the drill.

In an embodiment, the suspension assembly 13 contains a motor 49 to automatically position the locator box 5 at any point along the suspension assembly 13.

In an embodiment, a wheel 51 is rotatably coupled to the motor 49, where the wheel 49 rests on the suspension assembly 13, and wherein the remote control device 17 can transmit a signal to the motor 49, instructing the motor 49 to operate, moving the wheel 51, motor 49 and locator box 5 to any position along the suspension assembly 13.

In an embodiment, the locator box 5 is automatically moved alongside the drill head whenever the drill head changes position.

In an embodiment, the locator box 5 records the signal strength of the transmitter 11.

In an embodiment, the remote control device 17 issues an alert when the locator box 5 records a background noise level that may potentially interfere with transmission.

In an embodiment, the suspension assembly 13 is constructed from one or more materials selected from the group consisting of metals, plastics, ropes, cables, cabling, and wire.

While exemplary embodiments have been specifically disclosed, it should be understood that the practice of this invention is not limited to those embodiments. Modifications and variations falling within the spirit of the invention will occur to those skilled in the art. Therefore, it is not intended that the scope of the invention be determined by the disclosed exemplary embodiments, but rather should be determined by the breadth of the appended claims.

I claim:

1. A method for horizontal drilling under a body of water or other obstacle impassable by foot, comprising:

providing a locator box;

providing a horizontal drill rig with a drill head;

providing a transmitter operably coupled to the drill head;

providing a suspension assembly extending over the obstacle above a bore hole line;

providing a remote control device paired with the locator box capable of wirelessly sending instructions and wirelessly receiving data from the locator box;

A.) operably coupling the locator box to the suspension assembly;

wherein the suspension assembly allows the locator box to be positioned at any point along the suspension assembly, B.) drilling along the bore hole line using the horizontal drill rig;

C.) remotely using the locator box at regular intervals to collect data on the position, pitch and temperature of the drill head;

D.) redirecting the drill head if it strays off of the bore hole line using the data from the locator box;

repeating steps B through D until the drill head has passed beyond the obstacle impassible by foot.

2. The method of claim 1, wherein the obstacle impassable by foot is an obstacle from the group consisting of a body of water or a road.

3. The method of claim 2, wherein the obstacle impassable by foot is a body of water, wherein a sonar device is mounted under the locator box, wherein the sonar device is used in order to get detailed information on how deep the body of water is over the drill head, and wherein the depth of the body of water is used to calculate the safe depth for horizontal drilling under the body of water.

4. The method of claim 1, wherein the locator box is a modified locator box, wherein a trigger of the locator box has been coupled to a servo that can depress or release the trigger, wherein the servo can be remotely activated by the remote control device, wherein a camera has been attached to the suspension assembly such that the camera's view includes the locator box's display screen, and wherein the camera can be wirelessly activated and wirelessly send pictures or video to the remote control device.

5. The method of claim 4, wherein the remote control device is selected from the group consisting of a laptop, a cell phone, and a tablet.

6. The method of claim 4, comprising a waterproof housing holding the locator box when the locator box is attached to the suspension assembly.

7. The method of claim 1, wherein the suspension assembly uses two parallel lines, a first line located above the locator box, and a second line located below the locator box.

8. The method of claim 1, wherein the suspension assembly a first line operably coupled to a first carabiner of the locator box, and a second line operably coupled to a second carabiner of the locator box.

9. The method of claim 1, wherein the transmitter alerts the remote control device upon contacting an electrical source.

10. The method of claim 1, wherein the remote control device can transmit a signal to operate the drill head.

11. The method of claim 10, wherein the remote control device can transmit a signal to stop drilling, in the event of an emergency.

12. The method of claim 1, wherein the suspension is marked with warning signs to warn away observers from the immediate area around the drill.

13. The method of claim 1, wherein the suspension assembly contains a motor to automatically position the locator box at any point along the suspension assembly.

14. The method of claim 13, wherein a wheel is rotatably coupled to the motor, wherein the wheel rests on the suspension assembly, and wherein the remote control device can transmit a signal to activate the motor, moving the wheel, motor and locator box to any position along the assembly.

15. The method of claim 13, wherein the locator device is automatically moved alongside the drill head whenever the drill head changes position.

16. The method of claim 1, wherein the locator box records the signal strength of the transmitter.

17. The method of claim 1, wherein the remote control device issues an alert when the locator box records a background noise level that may potentially interfere with transmission.

18. The method of claim 1, wherein the suspension assembly is constructed from one or more materials selected from the group consisting of metals, plastics, ropes, cables, cabling, and wire.

19. An apparatus for horizontal drilling under an obstacle impassable by foot, comprising:

a locator box;

a horizontal drill rig with a drill head;

a transmitter operably coupled to the drill head;

a suspension assembly extending over the obstacle above a bore hole line;

a remote control device paired with the locator box capable of wirelessly sending instructions and wirelessly receiving data from the locator box, wherein the locator box is operably coupled to the suspension assembly, and wherein the suspension assembly allows the locator box to be positioned at any point along the suspension assembly.

20. The apparatus of claim 19, wherein the obstacle impassable by foot is an obstacle selected from the group consisting of a body of water and a road.

21. The apparatus of claim 20, wherein the obstacle impassable by foot is a body of water, wherein a sonar device is mounted under the locator box, wherein the sonar device is used in order to get detailed information on how deep the body of water is over the drill head, and wherein the depth of the body of water is used to calculate the safe depth for horizontal drilling under the body of water.

22. The apparatus of claim 19, wherein the locator box is a modified locator box, wherein a trigger of the locator box has been coupled to a servo that can depress or release the trigger, wherein the servo can be remotely activated by the remote control device, wherein a camera has been attached to the locator box's display screen, and wherein the camera can be wirelessly activated and wirelessly send pictures or video to the remote control device.

23. The apparatus of claim 19, wherein the remote control device is a laptop, cell phone, or tablet.

24. The apparatus of claim 19, wherein the suspension assembly has a waterproof housing holding the locator box when the locator box is operably coupled to the suspension assembly.

25. The apparatus of claim 19, wherein the suspension assembly uses two parallel lines, a first line located above the locator box, and a second line located below the locator box.

26. The apparatus of claim 19, wherein the suspension assembly uses a first line operably coupled to a first carabiner of the locator box, and a second line operably coupled to a second carabiner of the locator box.

27. The apparatus of claim 19, wherein the transmitter alerts the remote control device upon contacting an electrical source.

28. The apparatus of claim 19, wherein the remote control device is selected from the group consisting of a laptop, cell phone, and a tablet.

29. The apparatus of claim 19, wherein the remote control device transmits a signal to operate the drill head.

30. The apparatus of claim 29, wherein the remote control device transmits a signal to stop drilling, in the event of an emergency.

31. The apparatus of claim 19, wherein the suspension assembly is marked with warning signs to warn away observers from the immediate area around the drill.

32. The apparatus of claim 19, wherein the suspension assembly contains a motor to automatically position the locator device at any point along the assembly.

33. The apparatus of claim 32, wherein a wheel is rotatably coupled to the motor, wherein the wheel rests on the suspension assembly, and wherein the remote control device can transmit a signal to the motor instructing the motor to operate, moving the wheel, motor and locator device to any position along the assembly.

34. The apparatus of claim 32, wherein the locator device is automatically moved alongside the drill head whenever the drill head changes position.

35. The apparatus of claim 19, wherein the locator box records the signal strength of the transmitter.

36. The apparatus of claim 19, wherein the remote control issues an alert when the locator box records a background noise level that may potentially interfere with transmission.

37. The apparatus of claim 19, wherein the suspension assembly is constructed from one or more materials selected from the group consisting of metals, plastics, ropes, cables, cabling, and wire.

* * * * *